US006156488A

United States Patent [19]

Marsden et al.

[11] Patent Number: 6,156,488

[45] Date of Patent: Dec. 5, 2000

[54] PHOTOGRAPHIC BLEACH COMPOSITIONS

[75] Inventors: Peter Douglas Marsden, North Harrow; John Richard Fyson, London, both of United Kingdom

[73] Assignee: Eastman Kodak Company, Rochester, N.Y.

[21] Appl. No.: 08/261,667

[22] Filed: Jun. 17, 1994

Related U.S. Application Data

[63] Continuation of application No. 07/971,843, Jan. 22, 1993, abandoned.

[30] Foreign Application Priority Data

Jul. 26, 1990 [GB] United Kingdom ..... 9016472
Jul. 24, 1991 [EP] European Pat. Off. .. PCT/EP91/01377

[51] Int. Cl.[7] ..... G03C 7/42

[52] U.S. Cl. ..... 430/393; 430/373; 430/414; 430/943

[58] Field of Search ..... 430/373, 393, 430/414, 430, 460, 461, 943

[56] References Cited

U.S. PATENT DOCUMENTS

| | | | |
|---|---|---|---|
| 4,113,490 | 9/1978 | Fujiwhara et al. . | |
| 4,277,556 | 7/1981 | Koboshi et al. | 430/393 |
| 4,301,236 | 11/1981 | Idota et al. | 430/393 |
| 4,328,306 | 5/1982 | Idota et al. | 430/943 |
| 4,454,224 | 6/1984 | Brien et al. | 430/393 |
| 4,526,860 | 7/1985 | Kitchin | 430/373 |
| 4,578,345 | 3/1986 | Ohno et al. | 430/943 |

FOREIGN PATENT DOCUMENTS

| | | |
|---|---|---|
| 54-001026 | 1/1979 | Japan . |
| 61-250647 | 4/1985 | Japan . |
| 61-261739 | 5/1985 | Japan . |
| 1268126 | 3/1972 | United Kingdom . |
| 1399481 | 7/1975 | United Kingdom . |
| 1403418 | 8/1975 | United Kingdom . |
| 1560046 | 1/1980 | United Kingdom . |
| 1560572 | 2/1980 | United Kingdom . |
| 2113414 | 8/1983 | United Kingdom . |

*Primary Examiner*—Hoa Van Le

[57] ABSTRACT

A method of processing an imagewise exposed photographic silver halide material which includes a redox amplification dye image-forming step and a bleach step using an aqueous solution of hydrogen peroxide or a compound capable of releasing hydrogen peroxide.

6 Claims, No Drawings

PHOTOGRAPHIC BLEACH COMPOSITIONS

This application is a continuation of application Ser. No. 07/971,843, filed Jan. 22, 1993, now abandoned.

This invention relates to photographic bleach compositions for use in redox amplification processes.

There are a number of proposals in the art to use peroxy compounds, eg hydrogen peroxide or a compound capable of releasing hydrogen peroxide, in bleach compositions in conventional colour processes. In U.S. Pat. No. 4,277,556 there are described bleach solutions consisting of some 50 ml/l 30% hydrogen peroxide solution and 30 ml/l concentrated acetic acid. Such solutions however do not bleach the entire amount of silver present. U.S. Pat. No. 4,454,224 describes an improvement on the above in which the bleach solution further contains a polyacetic acid and is alkaline having a pH of 7 or more. Other peroxide bleach solutions must contain an organic metal complex salt, eg U.S. Pat. No. 4,301,236, while others must employ a bleach accelerator eg, Japanese specifications 61/250647A and 61/261739A. In spite of all these suggestions no such solution has ever been used commercially.

Redox amplification processes have been described, for example in British Specification Nos. 1,268,126, 1,399,481, 1,403,418 and 1,560,572. In such processes colour materials are developed to produce a silver image (which may contain only small amounts of silver) and then treated with a redox amplifying solution (or developer-amplifier) to form a dye image. The redox amplifying solution contains a reducing agent, for example a colour developing agent, and an oxidising agent which will oxidise the colour developing agent in the presence of the silver image which acts as a catalyst. Oxidised colour developer reacts with a colour coupler (usually contained in the photographic material) to form image dye. The amount of dye formed depends on the time of treatment or the availability of colour coupler rather than the amount of silver in the image as is the case in conventional colour development processes. Examples of suitable oxidising agents include peroxy compounds including hydrogen peroxide, cobalt (III) complexes including cobalt hexammine complexes, and periodates. Mixtures of such compounds can also be used. A particular application of this technology is in the processing of silver chloride colour paper, especially such paper with low silver levels.

If the level of silver halide employed in the photographic material is low enough it may be possible to dispense with any bleaching and/or fixing steps. At present, however, it is often necessary to have such processing steps in a redox amplification process. The present inventor has found that an aqueous hydrogen peroxide solution optionally containing some acid will perform as an efficient bleach solution when following redox amplification dye image formation.

According to the present invention there is provided a method of processing an imagewise exposed photographic silver halide material which includes a redox amplification dye image-forming step and a bleach step using an aqueous solution of hydrogen peroxide or a compound capable of releasing hydrogen peroxide.

The present bleach solutions are considerably more ecologically acceptable than traditional bleach solutions based on ferricyanides or ferric EDTA. Moreover, in a system already using a hydrogen peroxide amplification solution, the supply thereof to the amplification and bleach solutions could come from a common source thus saving on chemical storage.

In a preferred embodiment of the present invention, the bleach step follows immediately after image formation with or without an intermediate acid stop bath comprised for example of dilute acetic acid.

A hydrogen peroxide bleach for a silver image produced in a redox amplification may contain from 20 to 400 ml of 100 vol hydrogen peroxide solution per liter of bleach solution, preferably from 30 to 100 ml/liter. Such a solution may additionally contain an acid, eg acetic acid in a concentration of from 0.05 to 10.0 ml/liter. Its pH may be in the range 1 to 6, preferably from 3.0 to 5.5. High levels of acetic acid are not good for the environment and an alternative may be to use low levels of sodium bisulphate. This is acid and somewhat buffered. It may be possible to use more dilute peroxide at a higher processing temperature.

To fix the material it is immersed in concentrated sulphite fixer, either with or without a low level of sodium thiosulphate, eg 2 g/l, present. Alternatively a conventional thiosulphate fixer may be used.

The following Examples are included for a better understanding of the invention.

EXAMPLE 1

A multilayer coating containing approx 1.18 mg/dm$^2$ total silver was fogged to light and then developed in SOLUTION A for 3 min at 18° C. The ascorbic acid was present to suppress the formation of dye image. A good grey silver image was obtained.

Control—A strip of this developed silver was stopped in 2% acetic acid for 1 min followed by treatment in a ferric EDTA bleach-fix solution. The silver was completely removed in 15 seconds at 18° C. The strip was then washed and dried. Testing for silver was carried out by adding a drop of solution B (a dilute solution of sodium sulphide) to the bleached/fixed area. No brown stain was observed indicating that all the silver had been removed. When the untreated coating was tested, a heavy brown stain was observed indicating the presence of silver (chloride).

Invention—A strip of the same multilayer coating was developed as above to give a grey silver image. After development the strip was stopped by immersing it in a stop bath of 2% acetic acid for 1 min. It was then immersed at 18° C. in solution C (a 30 VOL of hydrogen peroxide containing a little acetic acid). After agitating for 30 secs the grey silver image turned white. On completion the strip was immersed in the fixer solution D for 30 secs. The strip was washed and dried and tested for silver using sodium sulphide as above. No brown stain was observed indicating that the silver had been completely removed (bleached and fixed).

EXAMPLE 2

Example 1 was repeated as far as the acetic stop bath for 1 min. The strip was then immersed in the fixer solution D for 30 secs followed (without washing) by immersing in the hydrogen peroxide bleach solution C for 30 secs. The image did not turn white (bleach) where it had been previously immersed in the fixer but did turn white above indicating that the fixer had "poisoned" the silver image and prevented it from bleaching. This experiment shows why it is necessary to pass straight from the acetic stop bath to the peroxide bleach in order to get the bleaching effect.

SOLUTIONS

| Solution A- Colour developer | |
|---|---|
| Sodium sulphite | 1.88 g |
| Sodium carbonate(anhydrous) | 21 g |
| Color Developer CD3 | 7.60 g |
| 1-hydroxyethylidene-1,1-diphosphonic acid | 1.20 g |
| N,N-diethylhyroxylamine | 0.74 g |
| Sodium hydroxide | 2.29 g |
| Ascorbic acid | 14 g |
| Water to | 1000 ml |
| pH | 10.1 |

| Solution B- Test solution | |
|---|---|
| Sodium sulphide | 0.25 g |
| Water to | 100 ml |

| Solution C- Hydrogen peroxide bleach | |
|---|---|
| 100 VOL Hydrogen peroxide | 333 ml |
| Water | 666 ml |
| Glacial acetic acid | 1.7 g |
| Final Volume | 1000 ml |
| pH to approx | 3.5 |

| Solution D- Sodium sulphite/Hypo fixer | |
|---|---|
| Sodium sulphite | 60 g |
| Sodium thiosulphate | 2.0 g |
| Water to | 1000 ml |

What is claimed is:

1. A method of processing an imagewise exposed photographic silver halide material, comprising the sequential steps of:

(a) developing and amplifying said material in a redox amplifying solution to form a dye image; and (b) bleaching said material in a bleach solution consisting essentially of an aqueous solution of hydrogen peroxide or a compound capable of releasing hydrogen peroxide.

2. A method of photographic processing as claimed in claim 1 in which the bleach solution has a pH of from 1 to 6.

3. A method of photographic processing as claimed in claim 2 in which the bleach solution has a pH of from 3.0 to 5.5.

4. A method of photographic processing as claimed in claim 1 in which the bleach solution contains from 20 to 400 ml of 100 vol hydrogen peroxide solution per liter of bleach solution.

5. A method of photographic processing as claimed in claim 1 in which the bleach solution contains from 30 to 100 ml of 100 vol hydrogen peroxide solution per liter of bleach solution.

6. A method of photographic processing as claimed in claim 1 further comprising:

(c) fixing said material.

* * * * *